United States Patent [19]

Burkybile

[11] 4,183,385

[45] Jan. 15, 1980

[54] HAND TOOL

[76] Inventor: George L. Burkybile, 1205 S. 31 St., Muskogee, Okla. 74401

[21] Appl. No.: 894,527

[22] Filed: Apr. 10, 1978

[51] Int. Cl.[2] ..... B25C 1/00

[52] U.S. Cl. ..... 145/29 A; 145/3

[58] Field of Search ..... 145/29 A, 3, 29 B, 29 C, 145/29 D, 36, 29 R

[56] References Cited

U.S. PATENT DOCUMENTS

| | | | |
|---|---|---|---|
| 1,239,394 | 9/1917 | Hovhannesian | 145/3 |
| 1,279,075 | 9/1918 | Bali | 145/3 |
| 2,501,757 | 3/1950 | Cagle | 145/3 |
| 3,745,598 | 7/1973 | Krell | 145/29 A |

FOREIGN PATENT DOCUMENTS

| | | | |
|---|---|---|---|
| 1111069 | 10/1955 | France | 145/3 |

*Primary Examiner*—Robert Louis Spruill
*Assistant Examiner*—J. T. Zatarga
*Attorney, Agent, or Firm*—Head & Johnson

[57] ABSTRACT

A hand tool comprising a main body portion or hammer head having a bore provided in one end thereof for removably receiving a plurality of interchangeable tips or working elements therein, and a yoke member pivotally secured to the head in the proximity of the bored end thereof and carrying a locking pin which is selectively engageable with the working element for removably securing the working element in a working position on the main body portion for providing a plurality of hand tools.

5 Claims, 10 Drawing Figures

HAND TOOL

BACKGROUND OF THE INVENTION

1. Field of the Invention

This invention relates to improvements in hand tools and more particularly, but not by way of limitation, to hand tools of the hammer type adapted for removably supporting a plurality of interchangeable working elements to provide a variety of hand tools having a common main body portion.

2. Description of the Prior Art

There are many hand tools, similar to the well known hammer, in widespread use today which comprise working elements or tips carried by a handle for manipulation by a worker in order to accomplish a task. Whereas the handle for these many tools is normally substantially identical, the working element or tip thereof may vary greatly, and as a consequence, a worker must usually provide himself with a supply of many different tools in order that he will have the proper tool at hand for the many tasks he wishes to perform. In order to reduce the number of tools a worker must maintain in supply, and thus reduce the overall cost to the worker, hammers or hand tools have been developed which comprise handles having head members thereon adapted to receive a plurality of different tips or working elements. Many of these tools utilize complementary threaded members for securing the independent tips to the common handle, such as that shown in the Fitzgerald U.S. Pat. No. 1,121,085, issued Dec. 15, 1914, and entitled "Hammer." However, these threaded connections directly between the head and working element have certain disadvantages in that during normal use of tools of this type, the threaded elements may "back-off" and result in a loosening of the tip of the hammer and cause an inefficient operation of the tool.

SUMMARY OF THE INVENTION

This invention contemplates a novel hammer adapted for supporting a plurality of interchangeable tips and which has been particularly designed and constructed for overcoming the foregoing disadvantages. The novel hammer is provided with a hammer head having a longitudinally extending bore provided at one end thereof for independently receiving each of a plurality of working elements therein. A transversely extending bore is provided in the hammer head and in communication with the longitudinal bore. A yoke member is pivotally secured to the hammer head in the proximity of the transverse bore and is provided with a reciprocal locking pin member for selective insertion into the transverse bore. Each working element for the hammer is provided with a longitudinally extending boss of a size and configuration complementary to the longitudinal bore of the head for insertion within the longitudinal bore. In addition, each longitudinally extending boss is provided with a transversely extending bore therein which may be disposed in substantial alignment with the transverse bore of the hammer head when the boss is disposed within the longitudinal bore. The yoke member may then be pivoted in one direction whereby the locking pin may be inserted through the aligned transverse bores for securely retaining the selected working element in position on the hammer head. When it is desired to change the working element, the yoke may be pivoted in a direction for withdrawing the locking pin from the aligned bores whereupon the first working element may be readily removed from the longitudinal bore and the next working element to be used may be substituted therefor. The novel hammer head is simple and efficient in operation and economical and durable in construction.

DESCRIPTION OF THE PREFERRED EMBODIMENTS

Figure 1:
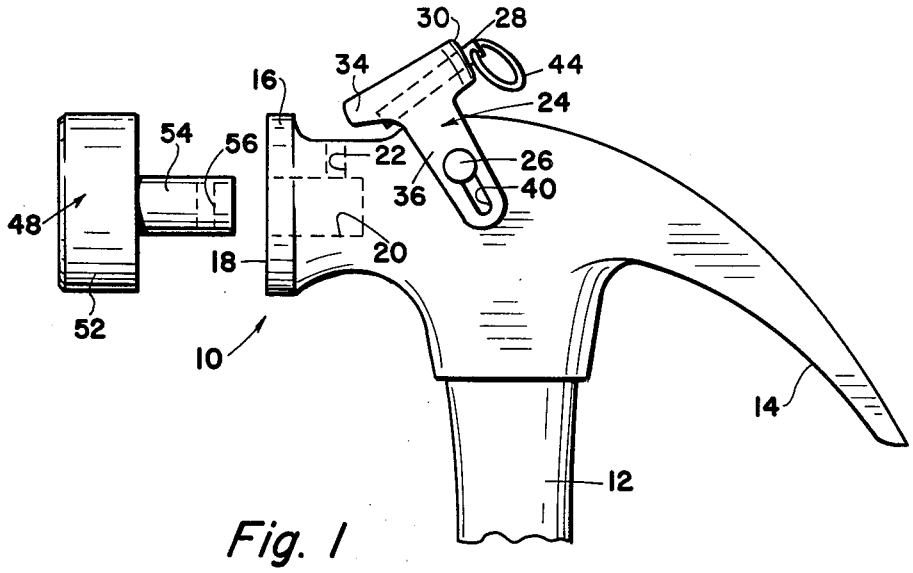
FIG. 1 is a side elevational view of a hammer head embodying the invention, with a tip element in spaced relation with respect thereto.

Referring to the drawings in detail, reference character 10 generally indicates a hammer head adapted to be secured to a suitable handle member 12 in any well known manner (not shown) for facilitating manipulation thereof. The head member 10 as shown herein is provided with a claw-type member 14 at one end thereof and a boss member 16 at the opposite end thereof. The outer face 18 of the boss member 16 is preferably substantially flat, and a centrally disposed bore 20 extends longitudinally therein for selectively receiving a plurality of interchangeable working elements therein as will be hereinafter set forth in detail. In addition, a transverse bore 22 is provided in the boss 16 and extends into communication with the longitudinal bore 20. A locking means generally indicated at 24 is pivotally secured to the head member 10 at 26 and extends in a direction toward the bore 22, and is provided with a locking pin 28 engagable with the transverse bore 22 in one position of the yoke member 24 for locking the selected working element in position with respect to the boss 16 as will be hereinafter set forth.

Figure 3:
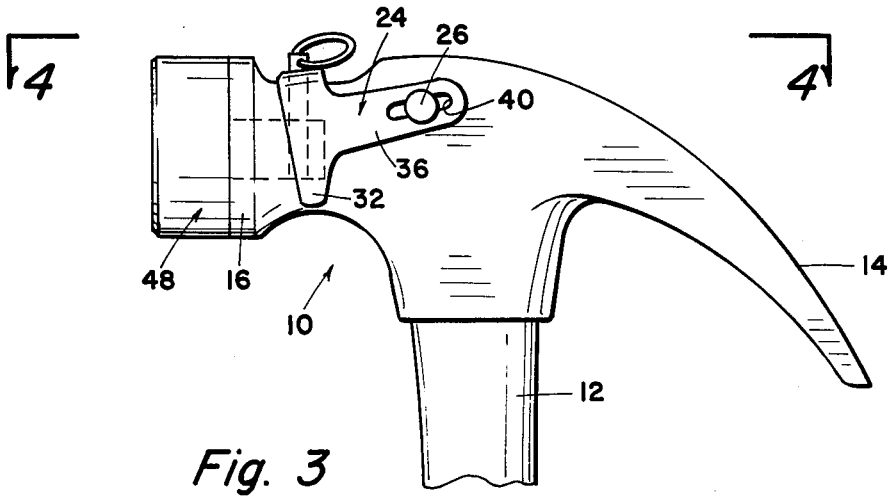
FIG. 3 is a side elevational view of a hammer head embodying the invention with the working tip element secured in the head member.
Figure 6:
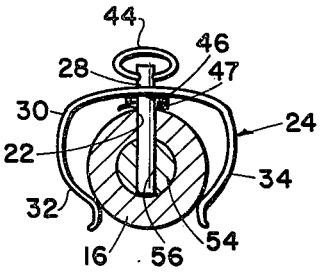
FIG. 6 is a sectional view taken on line 6—6 of FIG. 5.
Figure 4:
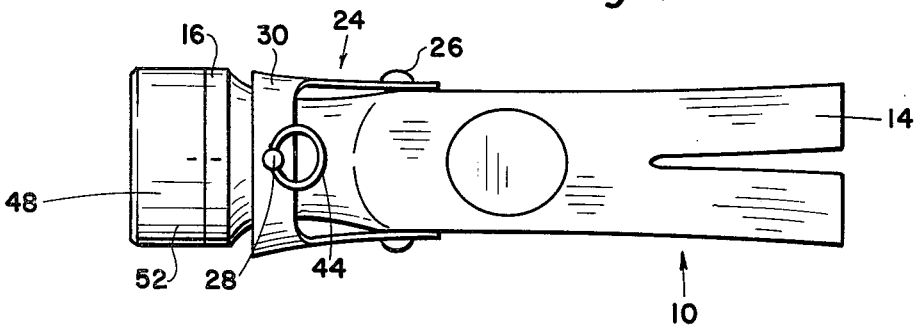
FIG. 4 is a view taken on line 4—4 of FIG. 3.
Figure 8:
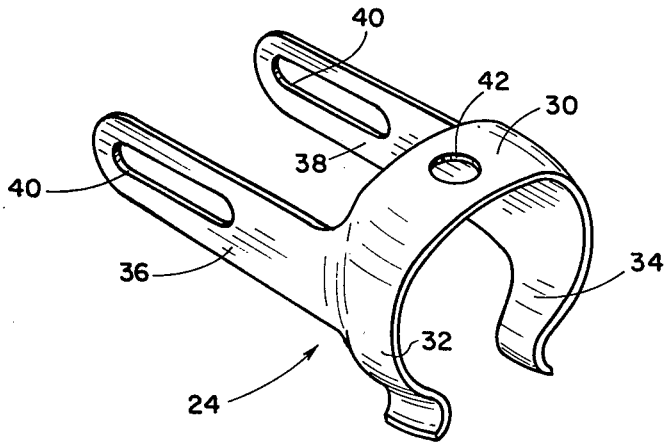
FIG. 8 is a perspective view of a yoke member which may be utilized in a hammer head embodying the invention.

The locking means 24 comprises a substantially inverted U-shaped yoke member 30 spanning the width of the boss 16 and having the oppositely disposed legs 32 and 34 thereof loosely disposed on opposite sides of the boss member in one pivotal position of the yoke, as particularly shown in FIGS. 3 and 4. The flange members 36 and 38 extend outwardly from each leg 32 and 34, respectively, and are substantially parallel with respect to each other as particularly shown in FIG. 8. The flanges 36 and 38 are preferably integral with the respective leg member and are preferably co-planar therewith, but not limited thereto. An elongated slot 40 is provided in the proximity of the outer end of each flange 36 and 38 for receiving the pivot pin 26 therethrough in order to facilitate pivotally securing the yoke 30 to the hammer head 10. In addition, a substantially centrally disposed aperture 42 is provided on the bracket 30 for slidably receiving the locking pin 28 therethrough. It is preferable to provide a suitable ring or handle element 44 on the outer end of the pin 28 for facilitating use thereof as will be hereinafter set forth.

Figure 5:
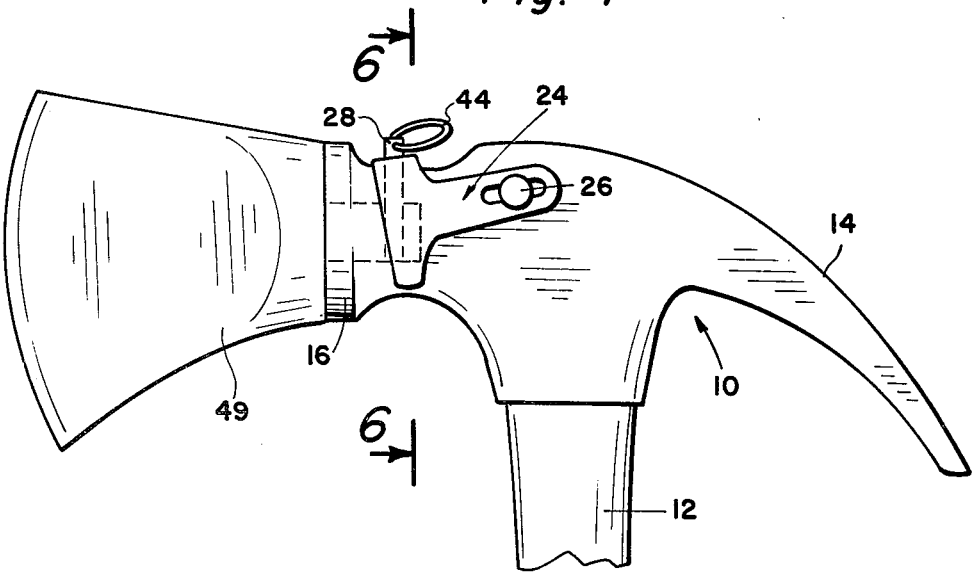
FIG. 5 is a side elevational view of a hammer head embodying the invention and illustrated with an alternate working element secured thereto.
Figure 7:
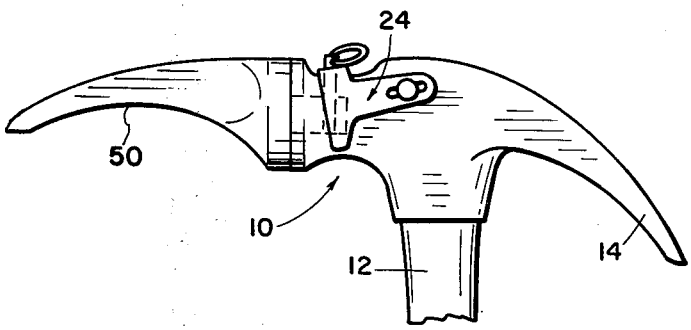
FIG. 7 is a side elevational view of a hammer head embodying the invention and illustrated with still another alternate working tip element secured thereto.

A suitable stop member 46 is disposed around the outer periphery of the pin 28 and is secured in position in the proximity of the inner surface of the bracket 30 by a cotter pin 47, or the like, which extends transversely through the pin 28. In this manner the pin 28 is loosely secured within the aperture 42, but securely retained against accidental withdrawal therefrom during operation of the yoke 30. Substantially any type tip or working element may be utilized in combination with the head 10 to provide a useful hand tool. For example, a hammer head 48 of the usual or well known type shown in FIGS. 1 through 4 may be selectively or removably secured to the boss member 16 when it is desired to provide a hammer tool. Alternatively, a hatchet element 49 as shown in FIG. 5 may be utilized in combination with the head 10 to provide a hatchet tool, or a pick element 50 as shown in FIG. 7 may be utilized in combination with the head 10 to provide a pick too. There is substantially no limit to the type working element or tip which may be provided for use with the head 10.

Referring now to FIGS. 1 through 4, the hammer head 48 comprises a substantially circular element 52 of the general configuration of the well known hammer head, and is provided with a centrally disposed shank member 54 extending axially outwardly from one face thereof. The shank member 54 is of a length and diameter corresponding to the length and diameter of the bore 20 and is adapted for insertion therein. A diametrically extending bore 56 is provided in the shank 54 spaced slightly from the outer end thereof and is of a diametric size complementary to the diametric size of the bore 22. When the shank 54 is disposed within the bore 20 as shown in the drawings, the element 48 may be rotated about its own longitudinal axis for orientating the bore 56 for substantial axial alignment with the bore 22 whereby the pin 28 may be inserted through the bore 22 and into the bore 56 for locking the element 48 to the head 10.

Of course, each working element, such as the elements 49 and 50, are provided with shank members 54 for cooperating with the bore 20 to lock the respective element to the head 10 when desired, and as will be hereinafter set forth.

Figure 2:
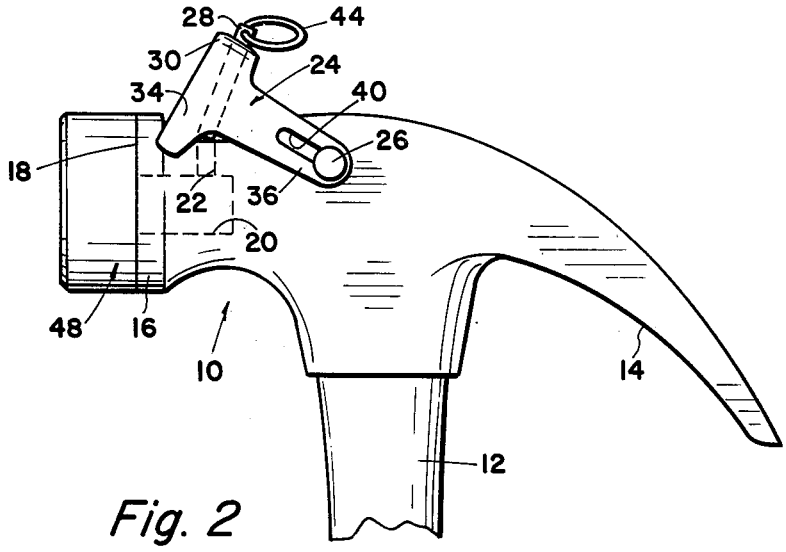
FIG. 2 is a side elevational view of a hammer head embodying the invention with a working tip element illustrated as initially installed on the head.

Referring now to FIGS. 1 through 3, in the event it is desirable to attach the hammer element 48 to the head 10, the handle member or ring 44 may be manually grasped and suitable pressure applied on the pin 28 for withdrawing the pin from and engagement with the bore 22 and for pivoting the yoke member 30 in a clockwise direction about the pivot 26, as shown in FIG. 1. The shank 54 may then be inserted within the bore 20 and the element 48 orientated properly for positioning the bore 56 in substantial axial alignment with the bore 22, as shown in FIG. 2. When the element 48 has thus been positioned in the boss 16, the yoke 30 may be rotated in an opposite direction for moving the pin 28 into the proximity of the open outer end of the bore 22, and placing the legs 32 and 34 on the opposite sides of the boss 16. Continued movement of the yoke 30 in this counterclockwise direction will move the pin 28 through the bore 22 and into the bore 56 as shown in FIG. 3, thus locking the element 48 securely in position in the boss 16. Of course, the elongated slots 40 provided in the flanges 34 and 36 cooperate with the pivot pin 26 for facilitating the pivoting of the yoke 30 during the locking the element 48 in the boss 16. In this manner, the head 10 may be utilized in the conventional manner of a hammer.

When it is desired to remove the element 48 from the head 10 for any reason, such as to interchange the element 48 with the element 50, the ring 44 may be manually grasped and suitable pressure applied to the pin 28 for withdrawing the pin from the bores 22 and 56, thus releasing the locking engagement of the shank 54 in the bore 20. The element 48 may then be readily removed from engagement with the boss 16, and replaced with the element 50, whereupon the element 50 may be locked on the boss 16 in the manner as hereinbefore set forth.

Figure 10:
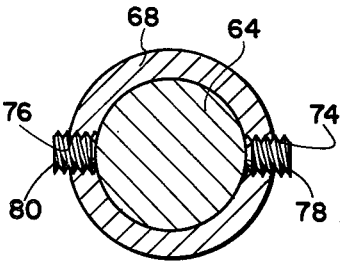
FIG. 10 is a sectional view taken on line 10—10 of FIG. 9.
Figure 9:
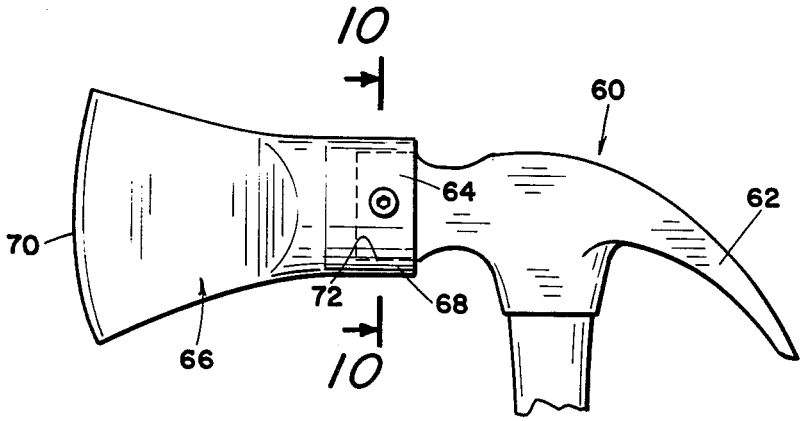
FIG. 9 is a side elevational view of a modified hammer head embodying the invention.

Referring to FIGS. 9 and 10, a modified head member embodying the invention is generally indicated by reference character 60. The overall configuration of the head member 60 is generally similar to the head member 10, and includes a claw member 62 at one end thereof and a boss member 64 at the opposite end thereof. The boss member 64 is a solid element, however, and is not provided with an internal longitudinally extending bore therein, and if desired may be of a size and configuration corresponding to the usual hammer head. In this embodiment, a plurality of interchangeable working tips or elements, such as the hatchet member 66, may be removably secured to the boss 64 for providing a variety of hand tools as hereinbefore set forth. The hatchet member 66, and any other desired working tip for use with the head member 60, is provided with a substantially cylindrical sleeve member 68 at the end thereof oppositely disposed from the working end 70, and the sleeve 68 is provided with a centrally disposed bore 72 extending longitudinally therein. The bore 72 is preferably of a diameter corresponding to the outer diameter of the boss 64 therein, and is preferably of a preselected depth for limiting the depth of insertion of the boss 64 therein for stability of the tool during use. A pair of oppositely disposed threaded bores 74 and 76 are provided in the sleeve 68 extending into communication with the bore 72 for receiving suitable set screws 78 and 80, respectively, therein. When the box 68 has been properly inserted within the bore 72, the set screws 78 and 80 may be tightened within the respective bores 74 and 76 for engaging the outer periphery of the boss 64 to securely retain the boss within the bore 72 until it is desired to remove the working element 70 therefrom.

From the foregoing, it will be apparent that the present invention provides a novel hand tool having a hammer head type main body portion adapted for removably supporting a plurality of working tips or elements. The main body portion is provided with a boss member as one end thereof having a longitudinally extending central bore provided therein for receiving a complementary shank provided at one end of the working tip. A yoke member is pivotally secured to the main body portion in the proximity of the boss member and carries a locking pin which is engagable with a transverse bore provided in the shank of the working tip for efficiently and securely retaining the working tip in position on the main body portion, and readily removable from engagement therewith when it is desired to remove the working tool from the main body portion for any reason.

Whereas the present invention has been described in particular relation to the drawings attached hereto, it should be understood that other and further modifications, apart from those shown or suggested herein may be made within the spirit and scope of this invention.

What is claimed:

1. A hand tool for selectively supporting interchangeable working elements and comprising a main body member having a longitudinally extending bore provided in one end thereof for selectively receiving a working element therein, a transversely extending bore provided in the main body and in communication with the longitudinally extending bore, locking means pivotally secured to the main body member in the proximity of the bored end thereof and movable between locking and unlocking positions with respect to the transversely extending bore for removably securing the working element in a working position on the main body member, said locking means comprising a yoke member pivotally secured to the main body member and spanning the width thereof, a locking pin carried by the yoke member and engageable with the transverse bore in the locking position of the locking means for securing the working element in the working position, and wherein the yoke member comprises a substantially inverted U-shaped bracket having the opposite legs thereof loosely disposed on the opposite sides of the main body portion in the locking position of the locking means, and flange means extending outwardly from each leg of the U-shaped bracket and having elongated slot means therein for facilitating pivotally securing the yoke member to the main body member.

2. A hand tool as set forth in claim 1 and including stop means cooperating between the yoke member and locking pin for precluding accidental withdrawal of the locking pin from the yoke member.

3. A hand tool as set forth in claim 1 wherein the flange means is integral with and co-planar with the respective leg of the bracket.

4. A hand tool as set forth in claim 1, wherein the inverted U-shaped bracket member is provided with a substantially centrally disposed bore for receiving the locking pin therethrough.

5. A hand tool as set forth in claim 1 wherein stop means is disposed around the locking pin in the proximity of the inverted U-shaped bracket member, and cotter pin means extends through the locking pin for cooperating with the stop member to preclude accidental withdrawal of the pin from the centrally disposed bore.

* * * * *